United States Patent [19]

Nagata

[11] Patent Number: 4,616,448

[45] Date of Patent: Oct. 14, 1986

[54] AUTOMATIC WORK LOADING DEVICE FOR USE IN GRINDING MACHINE

[75] Inventor: Tetsuya Nagata, Narashino, Japan

[73] Assignee: Seiko Seiki Kabushiki Kaisha, Chiba, Japan

[21] Appl. No.: 643,062

[22] Filed: Aug. 22, 1984

[30] Foreign Application Priority Data

Aug. 23, 1983 [JP] Japan ..... 58-130182[U]

[51] Int. Cl.[4] ..... B24B 47/22

[52] U.S. Cl. ..... 51/215 H; 51/236; 414/224; 221/251

[58] Field of Search ..... 51/215 H, 215 CP, 215 R, 51/215 HM, 215 UE, 237 R, 236, 266, 356; 414/224; 221/251, 278

[56] References Cited

U.S. PATENT DOCUMENTS

| | | | |
|---|---|---|---|
| 2,635,395 | 4/1953 | Arms et al. | 51/236 |
| 2,723,499 | 11/1955 | DIX | 51/236 |
| 2,824,665 | 2/1958 | Lamouria | 221/278 |
| 3,023,552 | 3/1962 | Grobey et al. | 51/236 |
| 3,874,128 | 4/1975 | Ishii | 51/236 |

FOREIGN PATENT DOCUMENTS

| | | | |
|---|---|---|---|
| 0571361 | 9/1977 | U.S.S.R. | 221/278 |

*Primary Examiner*—Frederick R. Schmidt
*Assistant Examiner*—Robert A. Rose
*Attorney, Agent, or Firm*—Robert E. Burns; Emmanuel J. Lobato; Bruce L. Adams

[57] ABSTRACT

A device for individually transferring workpieces comprises a loading chute for successively feeding by gravity individual workpieces to a standby position on a support member, and a pusher reciprocates through a forward stroke to push a workpiece from the standby position along the support member toward a working position while blocking the loading chute so as to prevent the next workpiece from dropping from the loading chute into the standby position and through a return stroke to unblock the loading chute to permit the next workpiece to drop from the loading chute into the standby position. A fluid delivery passage formed in the loading chute delivers pressurized fluid lubricant in a first fluid stream directed toward the standby position to assist in maintaining the workpiece in the standby position and delivers pressurized fluid lubricant in a second fluid stream directed toward the working position to assist the pusher in transferring the workpiece from the support member to the working position.

12 Claims, 4 Drawing Figures

AUTOMATIC WORK LOADING DEVICE FOR USE IN GRINDING MACHINE

BACKGROUND OF THE INVENTION

The present invention relates generally to automatic work loading devices for use in grinding machines and more particularly, to automatic work loading devices for handling extremely small-sized and lightweight workpieces.

In a centerless grinding machine of the so-called "one-shoe two-rolls" type, upper and lower rolls define therebetween a working position for a workpiece which is to be internally ground by a grinding wheel. In order to feed successive workpieces to the working position, a loading chute is disposed above the upper surface of a shoe, the loading chute being arranged to drop individual workpieces on the upper surface of the shoe. A reciprocable pusher is slidably disposed between the loading chute and the shoe and functions to load or feed successive workpieces to the working position.

During use, workpieces are charged into the loading chute and the chute is arranged such that one workpiece drops down onto the upper surface of the shoe when the pusher is in a retracted position. In this state, one workpiece is in a standby position on the upper surface of the shoe in readiness to be loaded in the working position. When in the standby position, the workpiece abuts against the end face of the pusher, and the workpiece is maintained in the standby position by the dead weight of the other workpieces charged in the loading chute. When the pusher is actuated, it advances through a forward stroke and pushes the workpiece from the standby position to the working position between the upper and lower rolls and, at the same time, discharges a previously ground workpiece from the work position into a discharge chute. When the pusher is actuated through a return stroke to its retracted position, another workpiece drops from the loading chute onto the upper surface of the shoe into the standby position.

SUMMARY OF THE INVENTION

An object of the present invention is to provide an automatic work loading device which maintains a workpiece in a standby position in a stable manner, which effects a positive feeding of the workpiece from the standby position to a working position, and which effects a positive discharge of a ground workpiece from the working position.

The foregoing and other objects are achieved by providing a fluid delivery passage within the loading chute, the fluid delivery passage branching at its lower end into two branch passages, one being directed toward a workpiece held in the standby position and the other being directed toward a workpiece held in the working position. Pressurized lubricant flowing through the fluid delivery passage is ejected out of the branch passages so that during the forward stroke of the pusher, the pusher blocks one of the branch passages and forces all of the lubricant to be directed out the other branch passage to assist in the feeding of a workpiece to the working position whereas when the pusher is in its retracted position, the lubricant flows through both branch passages to assist in lubricating the workpiece during grinding and to assist in stably maintaining a workpiece in the standby position.

In accordance with the invention, even if the workpieces are small in size or light in weight, they can be stably maintained in the standby position due to the force exerted thereon by the pressurized lubricant. Thus it is not necessary to rely solely on the size and weight of the workpieces contained in the loading chute to stably maintain a workpiece in the standby position. This avoids the possibility that two or more workpieces may drop from the loading chute onto the upper surface of the shoe while the pusher is in the retracted position thereby avoiding the misfeeding of plural workpieces to the working position during the same forward stroke of the pusher. This is particularly important in the case of automated processes in which the ground workpieces are successively fed to downstream work stations for processing.

DETAILED DESCRIPTION OF THE INVENTION

Figure 1:
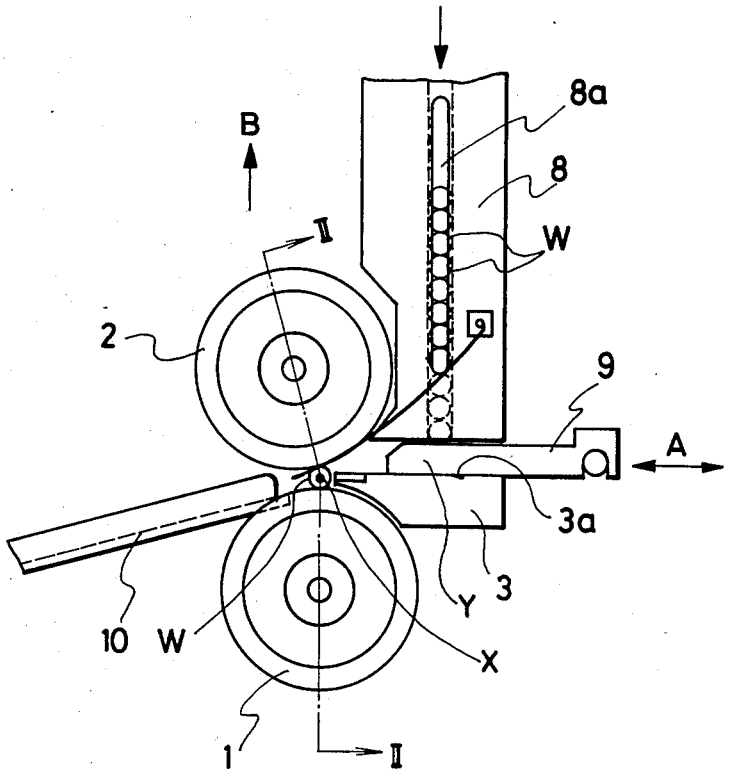
FIG. 1 is a side view of a centerless grinding machine utilizing the automatic work loading device of the present invention.
Figure 2:
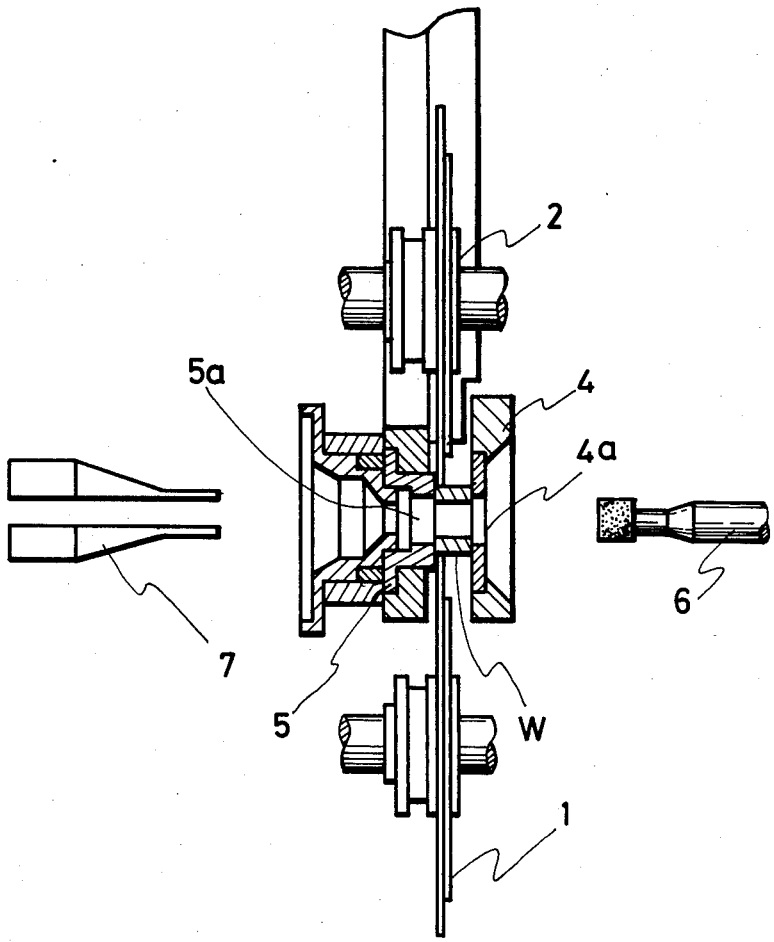
FIG. 2 is an enlarged cross-sectional view taken along the line II—II in FIG. 1.

FIGS. 1–2 show the principal parts of a centerless grinding machine embodying the automatic work loading device of the present invention. As known in the art, a lower roll 1 and an upper roll 2 define therebetween a working position X for a workpiece W which is rotatably supported in a centerless manner about its circumference by the rolls 1,2. A stationary shoe 3 extends transversely of the rolls 1,2 and the end face of the shoe coacts with the rolls to define the working position X, as explained in more detail hereinafter. As shown in FIG. 2, when a workpiece W is in the working position, it is held between a front plate 4 and a pusher rotor 5 which coact with the rolls 1,2 and the end face of shoe 3 to rotatably support the workpiece W in a centerless manner.

The front plate 4 is provided with a central opening **4*a* through which a grinding wheel 6 can be inserted to effect internal grinding of the workpiece W. As known in the art, the grinding wheel 6 is reciprocatingly driven so as to grind the inner surface of the workpiece W. The pusher rotor 5 is provided with a central opening 5*a* dimensioned to receive therethrough a sizing detector 7. The sizing detector 7 is reciprocatingly driven in synchronism with the reciprocation of the grinding wheel 6** so as to detect the inner diameter of workpiece W during the grinding operation.

As shown in FIG. 1, a loading chute 8 is disposed above the upper surface of the shoe 3 and contains a vertical work supplying passage **8*a* which is dimensioned to receive a column of workpieces W to be ground. The workpieces W fall by gravity downwardly to a discharge opening at the bottom of the work supplying passage 8*a*. A pusher 9 is reciprocably mounted on the upper surface of the shoe 3 to undergo reciprocable movement in a direction of the double-headed arrow A in forward and return strokes. When the pusher 9 moves rightwardly in FIG. 1 to the end of its return stroke, i.e., the pusher 9 is at its retracted position, the pusher is free of the work supplying passage 8***a* so as to permit one workpiece W to drop onto the upper surface of the shoe 3 and into a recessed portion 3*a* of the shoe which defines the standby position Y of the workpiece W (see FIG. 3). When the parts are in this state, the rolls 1,2 are rotated to effect rotation of the workpiece W which is supported in the working position X so as to permit internal grinding thereof by the grinding wheel 6. At the completion of the grinding operation, the upper roll 2 is displaced upwardly in the direction of arrow B so as to disengage from the workpiece W. Then when the pusher 9 moves leftwardly in FIG. 1 to the end of its forward stroke, the pusher 9 pushes or transfers the workpiece W from the standby position Y to the working position X and, at the same time, discharges the ground workpiece W from the working position X to a discharge chute 10.

In order to maintain the workpiece W in the working position when the upper roll 2 ascends, an elastic clamper 11 is provided for urging the workpiece W downwardly against the lower roll 1 and against the end face of the shoe 3. The elastic clamper 11 is attached at one end to the side of the loading chute 8 and its free end projects beyond the workpiece W situated in the working position X. By such a construction, as the pusher 9 moves through its forward stroke to transfer a workpiece from the standby position Y to the working position X, the workpiece W which is being fed to the working position pushes the elastic clamper 11 upwardly to thereby release the ground workpiece W which at that time occupies the working position X. In this manner, the ground workpiece W is unclamped and pushed out from the working position X by the advancing workpiece W, and the ground workpiece W drops down due to its dead weight and rolls down the inclined discharge chute 10.

To assist in feeding the workpieces W so that they drop freely down the work supplying passage 8*a* of the loading chute 8, lubricating oil, which also serves as a coolant, is fed into the work supplying passage 8*a*. The lubricating oil ensures that the workpieces W can drop down smoothly through the work supplying passage 8*a* onto the upper surface of the shoe 3.

Figure 3:
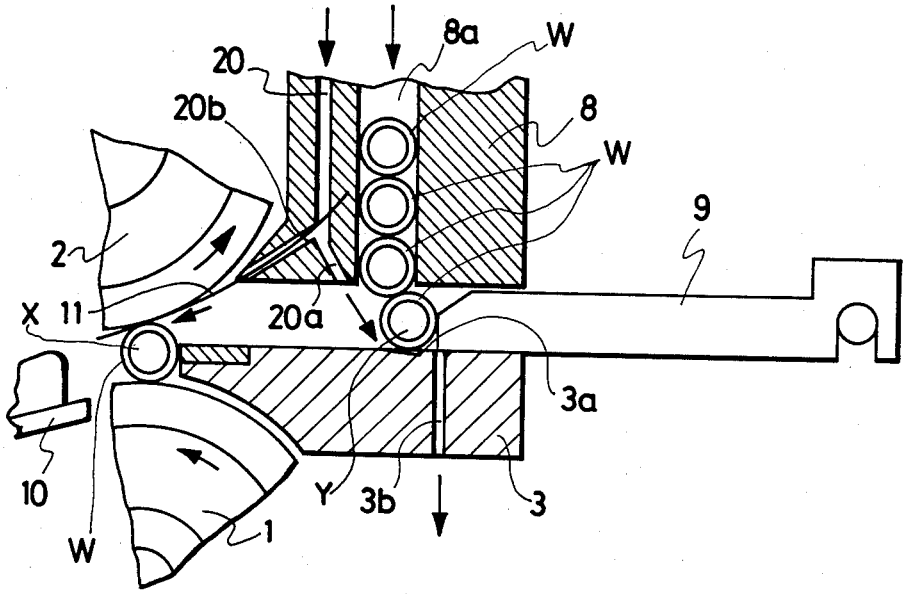
FIG. 3 is an explanatory view, partly in section, showing the location of the parts during the grinding state.
Figure 4:
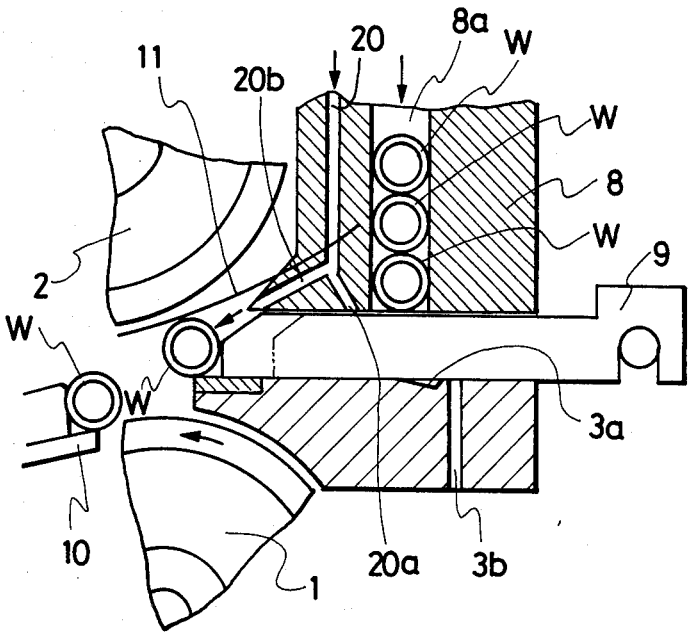
FIG. 4 is an explantory view, partly in section, showing the location of the parts during the work-feeding state.

Turning now to FIGS. 3–4, in accordance with the present invention, the loading chute 8 is provided with a fluid delivery passage 20 which extends downwardly in a direction parallel to the work supplying passage 8*a*. The lower end of the fluid delivery passage 20 branches into a branch passage 20*a* which is directed toward the standby position Y and a branch passage 20*b* which is directed toward the working position X. Highly pressurized lubricant is fed into the fluid delivery passage 20 and is ejected out the branch passages 20*a*, 20*b*.

As shown in FIG. 3, when the pusher 9 is in its retracted position at the end of its return stroke, a workpiece W drops downwardly into the standby position Y defined by the recessed portion 3*a* of the shoe 3 and the end face of the pusher 9. Pressurized lubricant flowing out the branch passage 20*a* is directed toward the workpiece W in the standby position Y, and the force of the highly pressurized lubricant is effective to stably maintain the workpiece W in the standby position. The shoe 3 is provided with a fluid passage 3*b* to provide a path for the withdrawal of the pressurized lubricant. At the same time, the highly pressurized lubricant is ejected from the branch passage 20*b* and directed toward the workpiece W which occupies the working position X so as to lubricate the frictional surfaces between the rotating workpiece W and the end face of the shoe 3 and the elastic clamper 11.

Upon completion of the grinding operation of the workpiece W located at the working position X, the upper roll 2 ascends, as shown in FIG. 4, thereby releasing its hold on the workpiece W. In synchronization with the ascending movement of the upper roll 2, the pusher 9 advances through its forward stroke to push the workpiece W from the standby position Y toward the working position X. As the pusher moves forwardly, the leading end thereof covers the opening of the branch passage 20*a* thereby closing the branch passage 20*a* and forcing all of the pressurized lubricant to flow through only the branch passage 20*b*. Consequently, the flow rate of lubricant through the branch passage 20*b* increases so that a greater fluid pressure is exerted on the workpiece W which is being fed to the working position X. This momentary increase in fluid pressure assists in effecting a positive and secure transfer of the workpiece W to the working position X.

As the pusher 9 nears the end of its forward stroke, the workpiece W is urged against the elastic clamper 11 so as to raise the clamper and release the ground workpiece W which at that moment occupies the working position X. While the elastic clamper 11 is being raised, the advancing workpiece W pushes the ground workpiece W from the working position X into the unloading chute 10. At the same time, the new workpiece W drops down from the end of the shoe 3 into the working position X assisted by the forward motion of the pusher 9, the downward bias of the elastic clamper 11 and the dynamic force of the pressurized lubricant ejected from the branch 20*b*. In this manner, the workpiece W is positively and securely fed to the working position X.

The pusher 9 is then retracted to its retracted position. Upon completion of the loading operation, the upper roll 2 descends so as to again support the new workpiece W in a centerless manner in the working position X in readiness for a grinding operation. As the pusher 9 retracts through its return stroke, highly pressurized lubricant again is permitted to flow out the branch passage 20*a* so as to stably maintain the next workpiece W in the standby position Y.

As above described, the automatic work loading device of the present invention obtains a positive and secure loading and unloading of workpieces to and from a working position of a centerless grinding machine. Highly pressurized lubricant is directed toward a standby position on the shoe so as to securely maintain a workpiece in the standby position, and highly pressurized lubricant is directed toward a working position defined, in part, by the end face of the shoe so as to improve the lubrication between the workpiece and the shoe. The force exerted by the highly pressurized lubricant against the workpiece in the standby position is effective to prevent more than one workpiece at a time from dropping onto the upper surface of the shoe. Accordingly, the loading device of the invention is sufficiently reliable to eliminate accidental breakages in machines located downstream from the grinding machine, such as a cutting machine, assembly machine and the like, and it is suitable for use as an automatic loading device even with workpieces of extremely small diameter and light weight.

I claim:

1. A device for individually transferring workpieces to a working position of a machine, the device comprising: a support member having an upper surface, the upper surface having means therealong defining a workpiece standby position and the upper surface terminating at one end adjacent to a workpiece working position; a loading chute disposed above the support member for receiving a supply of workpieces during use of the device, the loading chute having means for effecting the feeding by gravity of individual workpieces such that the workpieces drop one by one from a loading chute discharge opening onto the support member upper surface at the standby position so that only one workpiece at a time can occupy the standby position; reciprocable pushing means mounted to undergo reciprocable sliding movement through forward and return strokes relative to the support member upper surface and operable during a forward stroke to push a workpiece from the standby position along the support member upper surface toward the working position while blocking the loading chute discharge opening to prevent another workpiece from dropping from the loading chute into the standby position and operable during a return stroke to unblock the loading chute discharge opening to permit another workpiece to drop from the loading chute into the standby position; and fluid supply means for supplying a pressurized fluid and directing the pressurized fluid in a first fluid stream directed toward the standby position in a direction such that the first fluid stream assists in maintaining a workpiece in the standby position and directing the pressurized fluid in a second fluid stream directed toward the working position in a direction such that the second fluid stream assists the pushing means in transferring a workpiece from the one end of the support member upper surface to the working position.

2. A device according to claim 1; wherein the fluid supply means includes means defining a fluid passage which opens into the space through which the pushing means travels during its reciprocation and through which the first fluid stream flows in a direction toward the standby position, and wherein the pushing means includes means for blocking the fluid passage during its forward stroke of travel.

3. A device according to claim 1; wherein the fluid supply means comprises means defining a fluid delivery passage terminating in first and second branch passages through which flow the first and second fluid streams, and wherein the pushing means includes means for blocking the first branch passage during its forward stroke thereby temporarily interrupting the first fluid stream and causing an increased flow rate of the second fluid stream to thereby enhance the assistance provided by the second fluid stream in transferring a workpiece to the working position.

4. A device according to claim 3; wherein the fluid delivery passage is formed in the loading chute.

5. A device according to claim 4; including elastic clamping means for elastically clamping a workpiece in the working position while permitting relative motion between the workpiece and clamping means.

6. A device according to claim 5; wherein the elastic clamping means comprises an elastic clamping member attached at one end to the loading chute and projecting into the path of travel of an advancing workpiece being pushed toward the working position so that the advancing workpiece can engage with and flex the elastic clamping member out of clamping contact with the workpiece in the working position.

7. A device according to claim 3; including elastic clamping means for elastically clamping a workpiece in the working position while permitting relative motion between the workpiece and clamping means.

8. A device according to claim 7; wherein the elastic clamping means comprises an elastic clamping member attached at one end to the loading chute and projecting into the path of travel of an advancing workpiece being pushed toward the working position so that the advancing workpiece can engage with and flex the elastic clamping member out of clamping contact with the workpiece in the working position.

9. A device according to claim 3; wherein the fluid supply means comprises means for supplying a pressurized fluid lubricant.

10. A device according to claim 1; including elastic clamping means for elastically clamping a workpiece in the working position while permitting relative motion between the workpiece and clamping means.

11. A device according to claim 9; wherein the elastic clamping means comprises an elastic clamping member attached at one end to the loading chute and projecting into the path of travel of an advancing workpiece being pushed toward the working position so that the advancing workpiece can engage with and flex the elastic clamping member out of clamping contact with the workpiece in the working position.

12. A device according to claim 1; wherein the fluid supply means comprises means for supplying a pressurized fluid lubricant.

* * * * *